US005570915A

United States Patent [19]

Asadurian

[11] Patent Number: 5,570,915

[45] Date of Patent: Nov. 5, 1996

[54] FLUSH-MOUNTED DOOR LATCH

[75] Inventor: Armond C. Asadurian, Sherman Oaks, Calif.

[73] Assignee: Adams Rite Sabre International, Glendale, Calif.

[21] Appl. No.: 159,801

[22] Filed: Nov. 30, 1993

[51] Int. Cl.[6] ..... E05C 3/14

[52] U.S. Cl. ..... 292/242; 292/DIG. 31; 292/DIG. 37; 292/223; 292/216

[58] Field of Search ..... 292/240, 241, 292/242, DIG. 31, DIG. 37, 222–224, 216, 304, 229, 129, DIG. 63

[56] References Cited

U.S. PATENT DOCUMENTS

| | | | |
|---|---|---|---|
| 2,156,874 | 5/1939 | Schonitzer | 292/304 |
| 2,238,414 | 4/1941 | Erickson | 292/229 |
| 2,497,624 | 2/1950 | Nelson | 292/DIG. 31 |
| 2,700,290 | 1/1955 | Dall | 292/216 |
| 2,863,200 | 12/1958 | Miller et al. | 292/216 |
| 3,176,487 | 4/1965 | Dauenbaugh | 70/379 R |
| 3,384,404 | 5/1968 | Slattery | 292/216 |
| 4,003,614 | 1/1977 | Geer et al. . | |
| 4,006,951 | 2/1977 | Geer et al. . | |
| 4,025,096 | 5/1977 | Geer . | |
| 4,056,276 | 11/1977 | Jarvis | 292/216 |
| 4,194,377 | 3/1980 | Maeda | 292/216 |
| 4,438,964 | 3/1984 | Peters | 292/216 |
| 4,487,440 | 12/1984 | Beijer . | |
| 4,510,779 | 4/1985 | Ahad . | |
| 4,635,454 | 1/1987 | Brown | 292/216 |
| 4,978,153 | 12/1990 | Hirsch et al. | 292/216 |

*Primary Examiner*—Darnell M. Boucher
*Attorney, Agent, or Firm*—Knobbe, Martens, Olson & Bear

[57] ABSTRACT

A flush-mounted latching device is provided for two-sided operation of a door. A spring-loaded cam engages a corresponding roller bearing mounted adjacent to the door to prevent opening when the latch is in a locked condition. Touch-operated push-buttons provided on either side of the door may be actuated to release the latch and allow the door to spring open. A push-button mounted flush with the interior surface of the door releases the latch immediately upon depression. A push-button mounted substantially flush with the exterior surface of the door releases the latch when depressed and then released. From either side, the door opens in a direction corresponding to the movement of an operator's finger upon actuating the corresponding push-button.

43 Claims, 6 Drawing Sheets

FLUSH-MOUNTED DOOR LATCH

BACKGROUND OF THE INVENTION

1. Field of the Invention

This invention relates to latching devices and, in particular, to flush-mounted latching devices for use in interior doors of aircraft and similar applications where size, weight, durability, and ease of operation are of particular concern.

2. Description of the Related Art

Various latching devices are known for opening and closing doors. The most commonly known latching device is the conventional doorknob. By this familiar device a door may be opened or closed by turning or twisting a knob or handle on either side of a door to retract a wedge-shaped bolt which secures the door to the door frame. When the bolt is extended, it engages a corresponding strike mounted in the door frame to prevent the door from opening. When the bolt is retracted, the door may be swung open by application of a pulling or pushing force.

In aircraft or similar applications where space is limited (e.g., buses, motor-homes, automobiles, boats, etc.), it is desirable to provide a latching device that can be mounted flush with the door surface. Flush mounting eliminates the need to provide additional space to accommodate handles or knobs used to operate conventional door latching devices. Flush mounting is also desirable from a safety standpoint since it prevents injury to passengers from protruding knobs or handles during turbulent periods of flight in an aircraft or other injuries incident to cramped conditions within a moving vessel.

One type of flush-mounted latch known in the aircraft and automotive industry is based upon a retractable handle design. Most commonly, a hinged actuator handle or lever is pivotably mounted within a recessed cavity in the door. In its retracted position the actuator lies more-or-less flush with the door surface. In operation the handle is swung outward from the door surface to release the latch mechanism, allowing the door to be pushed or pulled to its open position. See, for instance, U.S. Pat. No. 4,025,096, assigned to Adams Rite Products, Inc., which discloses a latching device for cabinet doors having a swingably retractable handle. Other latch designs require the handle to be swung outward from the door surface and then either turned or rotated to release the latch mechanism.

A problem with retractable-handle type latching devices is that the exposed operating provisions tend to be subjected to a variety of abuse loads by operators. This results in frequent failures of the handles and latch mechanisms making them undesirable for commercial aircraft and similar uses. Moreover, the inherent nature of these types of devices is such that a certain degree of strength and dexterity is required to operate them. This may present a substantial obstacle for elderly or physically disabled persons, for example.

A second type of flush-mounted latch, having no exposed operating provisions, is known in the stereo cabinet industry. Typically, the latching of a glass cabinet door is accomplished by pushing the door against a spring-loaded latch which retains a magnet at its tip. The door is equipped with a corresponding ferromagnetic plate that is drawn to the magnet to retain the door when it is in its closed position. When the door is pushed in and then released, the latch springs outward accelerating the door away from the cabinet. When the latch reaches its end-of-travel, an inertial force is created in the door sufficient to break the magnetic force retaining the door, allowing it to swing free.

One drawback of magnetic latches is that they do not provide a positive lock. In other words, a closed door may be forced open without first releasing the latch. This characteristic is highly undesirable in aircraft and similar applications, since a door opening during flight could cause injury to passengers or allow luggage or other objects to fall free from their containers. Moreover, the vibrational and shock forces generated in an aircraft would easily exceed the retaining forces present in most magnetic latches. Another drawback of magnetic latches is that they typically are only designed to be actuated from the exterior side of a door and so are not suitable for use in applications requiring two-sided operation of a door.

Accordingly, there is a need for a positive-locking latch that can be mounted flush with a door surface, can be operated from both sides of the door, is easily used by elderly or physically disabled persons, and is not easily damaged. In particular, there is a need for a flush-mounted latch that can be operated within the five pound maximum load requirement prescribed by the ADA guidelines, 35658 Federal Register, Section 4.27.4, of Volume 56, No. 144.

SUMMARY OF THE INVENTION

For purposes of the description that follows and the accompanying claims the term "interior" will be used to refer to that side of a door toward which the door closes. The term "exterior" will be used to refer to that side of a door toward which the door opens.

In one embodiment, the present invention provides a positive-locking, touch-operated latch that can be operated with the exertion of a minimal amount of force, preferably less than about five pounds.

In another embodiment, the present invention provides a flush-mounted latch for two-sided operation of a door whereby the latch may be released from the interior side of the door by depressing a first flush-mounted push-button, or released from the exterior side of the door by depressing and then releasing a second flush-mounted push-button. From either side, the door opens in a direction substantially corresponding to the movement of an operator's finger upon actuating the corresponding push-button.

In another embodiment, the present invention provides a touch-operated latch for two-sided operation of a door wherein two push-buttons, mounted on opposing sides of a door, engage a single release lever for releasing the latch. A push-button mounted on the interior surface of the door includes a contact surface for engaging the release lever when the push-button is depressed. A push-button mounted on the exterior surface of the door includes a pawl for engaging the release lever when the push-button is depressed and then released.

In another embodiment, the present invention provides a spring-loaded cam for use in a door latching device. The cam is generally oblong in shape and has an opening at one end for engaging an adjacently mounted strike assembly disposed in a door frame. A notch formed in the peripheral surface of the cam allows it to be locked in place in its spring-loaded captive position until the latch is actuated. A circumferentially extending recessed area formed in the peripheral surface of the cam engages a stop for limiting the angular rotation of the cam between predetermined limits.

In another embodiment, the present invention provides a method for two-sided touch operation of a door latch wherein a latch may be released by either depressing a first push-button disposed on the interior side of a door, or by depressing and then releasing a second push-button disposed on the exterior side of the door.

Other features and advantages of the present invention will become apparent from the following detailed description of the preferred embodiments having reference to the accompanying drawings.

DESCRIPTION OF THE PREFERRED EMBODIMENTS

Figure 1:
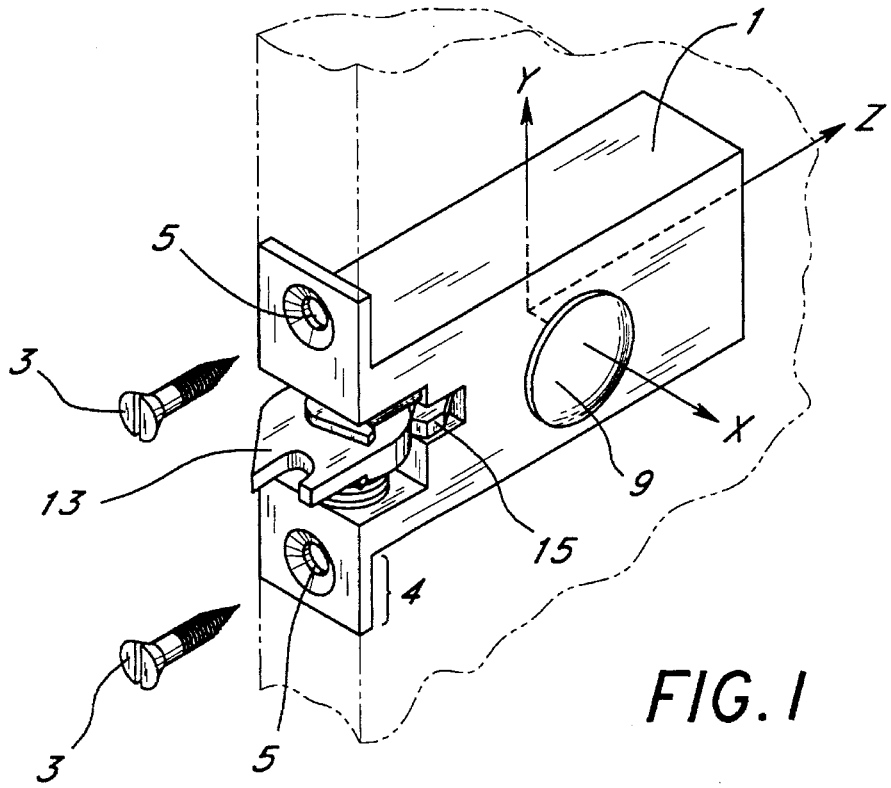
FIG. 1 is an isometric view showing the interior side of a flush-mounted latch having features of the present invention, the door and frame being shown in phantom for illustration purposes only.
Figure 2:
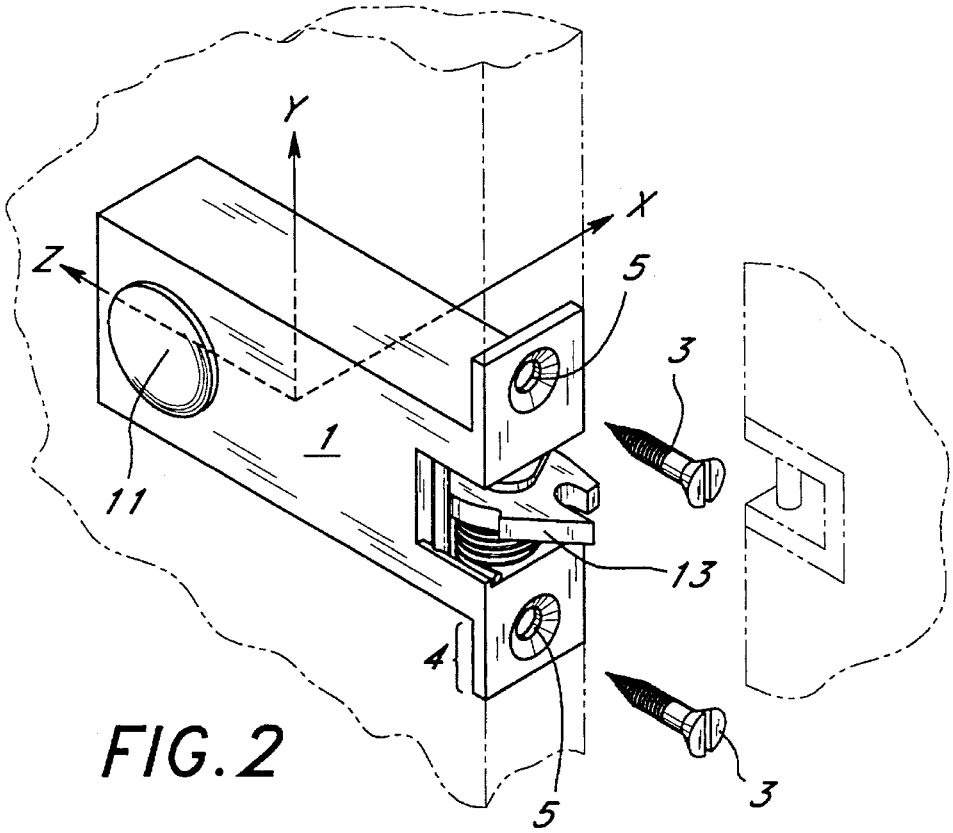
FIG. 2 is an elevational view showing the exterior side of a flush-mounted latch having features of the present invention, the door and frame being shown in phantom for illustration purposes only.

Having reference now to the drawings, FIGS. 1 and 2 disclose an assembled flush-mounted latch embodying features of the present invention.

Latch housing 1 contains most of the inner-workings of the latch and is mounted within an opening formed in a door (shown in phantom). The particular dimensions of the latch housing shown are about 3.79 inches long, 1.80 inches high and 0.90 inches thick, although any similarly compact shape may be used. Larger latch housings may be suitable for use in thicker or heavier-duty doors, but are not preferred for light-duty doors of the type commonly used in the interior of aircraft and similar environments.

The latch housing 1 may be constructed of any variety of materials having suitable stiffness, but glass reinforced molded thermoplastic is particularly preferred because of its combined properties of stiffness, durability and low weight. The flanged portions 4 of the latch housing 1 are preferably of uniform thickness and adapted to fit within corresponding recessed portions of the door, as shown, so that the latch lies substantially flush with the end of the door when installed. A thickness of at least 0.125 inches is preferred for the flanged portions 4 in order to provide the necessary support to the latch housing 1 and to resist deforming during ordinary use.

Preferably, the latch housing 1 is secured to the door using machine screws 3, which may be inserted through corresponding openings 5 formed in the flanged portions 4 of the latch housing 1. These openings 5 are preferably countersunk, as shown, so that the screws 3 lie substantially flush with the exposed end side of the latch housing 1 when the latch is installed in the door. Additional support may optionally be provided by adding escutcheon plates (not shown) on the interior and exterior sides of the latch housing 1.

The latch housing 1 preferably has formed therein at one end an opening within which a spring-loaded cam 13 is pivotably mounted. For cost reasons and ease of machining, a rectangular opening is preferred, as shown in FIG. 2, although any other shaped opening may be alternatively be used provided that clearance is maintained between the housing 1 and the cam 13. An additional, smaller recessed opening is also preferably provided for accommodating rotational movement of a lock bar 15 adapted to engage the cam 13, as shown in FIG. 1. Again, a rectangular opening is preferred for cost and machining purposes, although other shapes may be used.

Push-buttons 9 and 11 are disposed on the interior and exterior sides of the latch housing 1, respectively, as shown in FIGS. 1 and 2. These allow for touch-operation of the door from either side. In the particular embodiment shown, push-buttons 9 and 11 are mounted in recessed sockets formed in the latch housing 1 so that they lie substantially flush with the surface of the latch housing 1. The latch housing 1, in turn, is mounted substantially flush with the door, as shown. Alternatively, the latch housing 1 may be mounted entirely within a hollowed portion of a door with push-buttons 9 and 11 extending through apertures formed in the door's surface.

The particular disposition of the push-buttons 9 and 11 relative to the latch housing 1 and to one another may be varied considerably from what is shown in FIGS. 1 and 2 without departing from the scope of the present invention. Substantially non-opposed disposition of the push-buttons 9 and 11 is preferred, however, in order to avoid possible interference. In particular, push-button 9 is preferably slightly off-set from the horizontal z-axis which bisects the latch housing 1 lengthwise, as shown in FIG. 1. Push-button 11 is off-set from the vertical y-axis which bisects the latch-housing laterally, as shown in FIG. 2. Many other configurations are possible, however.

Similarly, the size and shape of push-buttons 9 and 11 may be varied, as desired, although a rounded, slightly convex shape is preferred, as shown in FIGS. 1 and 2. In the particular embodiment shown, the push-buttons 9 and 11 have a diameter of about 1.5 inches and protrude no further than about 0.14 inches from the outer surface of the latch housing 1 in their fully-released or rest state. Alternatively, any touch-operated actuation device may be used, including, but not limited to lever arms, pneumatic controls, membrane switches, etc.

Figure 3:
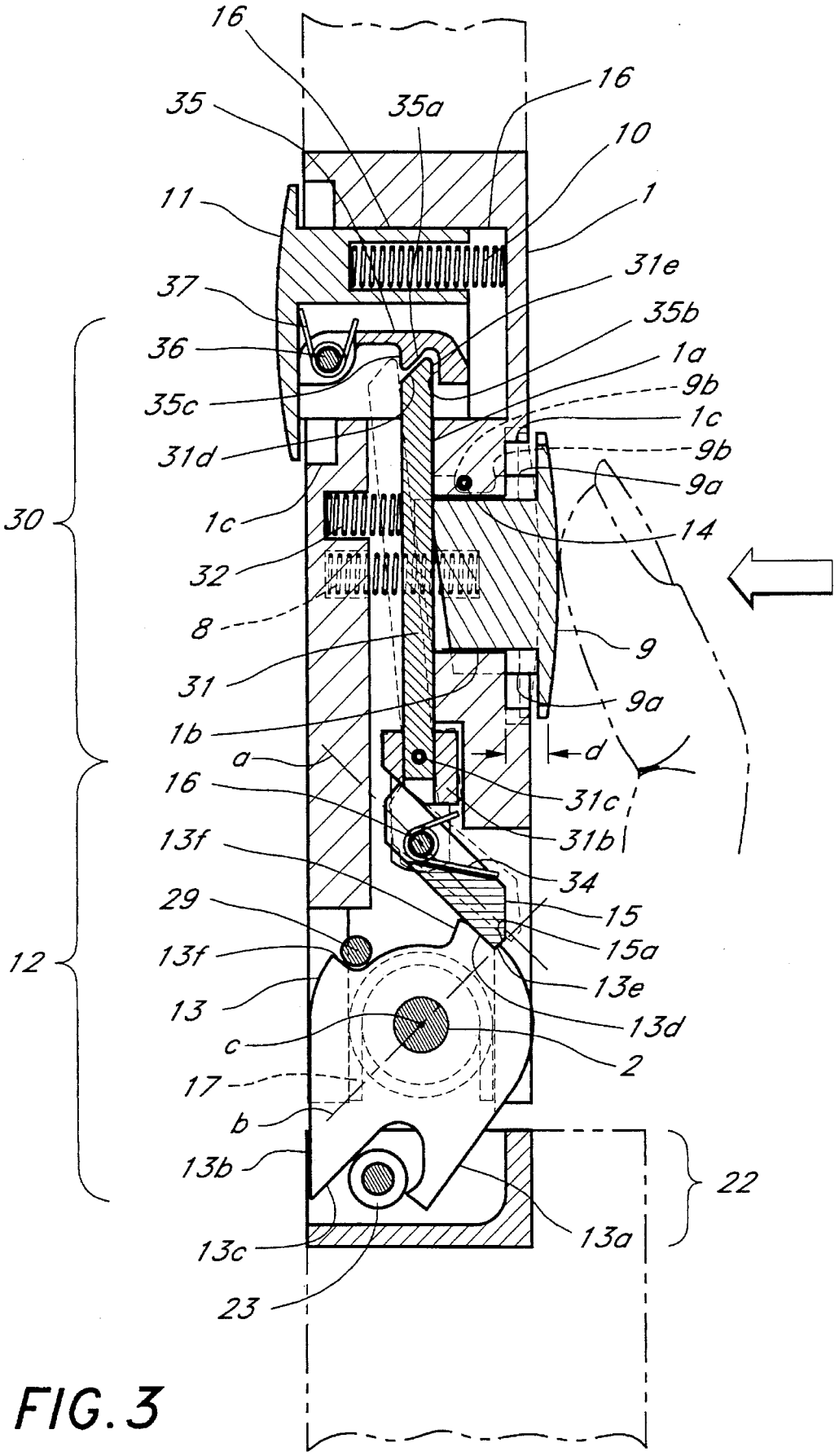
FIG. 3 is a sectional top-view of a flush-mounted latch having features of the present invention.

FIG. 3 shows a sectional top-view of a flush-mounted latch having features of the present invention. A latch assembly 12 consists primarily of a cam 13, for retaining the door relative to the door frame, and a lock bar 15 for locking the cam 13 in place. These components are preferably made of a hard material like precipitation hardened stainless steel in order to resist corrosion and wear during prolonged operation and to provide a positive lock.

Preferably, the cam 13 is pivotably mounted at one end of the latch housing 1 about a pivot pin 2 and is spring-loaded via torsion spring 17 (shown in dashed lines). As can be seen from FIG. 3, the cam 13 has a generally oblong or egg-shaped profile when viewed from the top. The larger end of the cam 13 is more-or-less rounded in shape with a diameter approximately equal to the thickness of the latch housing 1. The narrow end of the cam 13 extends outward from one end of the latch housing 1 for engagement with a corresponding strike assembly 22 disposed in a door frame (shown here in phantom for illustrative purposes only). A pair of fingers 13*a* and 13*b* formed in the narrow end of the cam 13 define a strike receiving opening adapted to engage and retain a corresponding roller bearing 23 mounted within the strike assembly 22.

The cam finger 13*a* is preferably formed such that when the latch is in its locked condition, as shown, the extended end of the finger 13*a* positively engages the roller bearing 23, thereby preventing the door from being pushed open. When the latch is released, however, cam finger 13*a* preferably completely disengages from roller bearing 23 as cam 13 rotates counter-clockwise, allowing the door to swing free. The base portion of cam finger 13*a* is preferably relatively thicker where it attaches to the cam 13 and slightly rounded in order to minimize stress concentration and to provide a more robust latch.

The opposing cam finger 13*b* is preferably formed such that it engages the roller bearing 23 both when the latch is in its locked condition, as shown, and when the latch is in its released condition, as will be shown later. The cam finger 13*b* is preferably wedge-shaped, having an inclined surface 13*c* adapted to maintain rolling contact with roller-bearing 23 while the door is being opened or closed. The included angle at the tip of the wedge-shaped cam extension member 13*b* is preferably about 45°.

The larger end of the cam 13 has a notch formed in its peripheral surface, defining first and second contact surfaces 13*d* and 13*e*, adapted for locked engagement with the lock bar 15. The preferred depth of this notch depends upon what materials are used in forming the cam 13 and lock bar 15 and their respective thicknesses. Softer materials and smaller thicknesses will require a deeper notch in order to maintain latch integrity under normal operating stresses. For cam and lock bar thicknesses of about 0.25 inches and for the preferred materials indicated above, a depth of about 0.03 inches is preferred. This provides a preferred overall load contact surface 13*e* of about 0.0075 square inches. Preferably, this contact surface 13*e* is formed substantially perpendicular to the elongated axis "a" of the lock bar 15 and lying in the radial plane "b" containing the pivot axis "c" of cam 13 in order to avoid creating any transverse reaction forces on the lock bar 15.

The larger end of the cam 13 also has formed in its peripheral surface a circumferentially extending recess defining end-of-travel surfaces 13*f*. These surfaces 13*f* act against a corresponding stop 29 to limit the rotation of the cam 13 to a predetermined arc of about 60°. The cam 13 may also include a separate actuator arm (not shown) for actuating a reset pin, the operation of which will be explained in more detail later.

The lock bar 15 has a generally rectangular or tilted parallelogram shape and is pivotably mounted within the latch housing 1 about a pivot pin 16. At one end of the lock bar 15 is a generally flattened contact surface 15*a* adapted for locked engagement with the notch surface 13*e* described above. Preferably, this contact surface 15*a* is substantially parallel to the corresponding contact surface 13*e* of the notch so that overall contact area is maximized. An opening formed in the other end of the lock bar 15 allows for the placement of a torsion spring 34 about the pivot pin 16 for urging the lock bar 15 toward engagement with the cam 13.

A release lever assembly 30 consists primarily of a release lever 31 and a coil compression spring 32. These components are adapted to disengage the lock bar 15 from the cam 13 when it is desired to release the latch. The release lever 31 has one end positioned within a corresponding opening in a hinged member 31*b*. These two elements are locked together by a pin 31*c* or, alternatively, the two elements may be formed as a single integral component by appropriate machining or casting operations.

The hinged member 31*b* is pivotably mounted within the latch housing 1 and shares the pivot pin 16 with the lock bar 15. An opening formed in the end of the hinged member 31*b* nearest the pivot pin allows it to receive the intersecting end of the lock bar 15 as it rotates about pivot pin 16. Mechanical contact is provided between the hinged member 31*b* and the lock bar 15 such that counter-clockwise rotation of the release lever 31 produces a corresponding counter-clockwise rotation of the lock bar 15, as illustrated in dashed lines. In the other direction, however, the release lever 31 and the lock bar 15 may be rotated independently of one another.

As previously mentioned, the torsion spring 34 acts between the hinged member 31*b* and the lock bar 15 to urge the lock bar 15 toward the surface of the cam 13. Preferably, the torsional reaction force exerted on the hinged member 31*b* is considerably smaller than the moment produced by the reaction force of the compression spring 32 acting on the release lever 31. In this preferred manner, the release lever 31 is spring-loaded toward the inner wall 1*a* of the latch housing 1, as shown in FIG. 3.

Push-buttons 9 and 11 are mounted within recessed sockets formed within the latch housing 1. An inner portion 1*b* of each socket accommodates sliding motion of the stem or main body of each push-button 9 and 11. An outer portion 1*c* of each socket accommodates in-and-out displacement of the head of each push-button 9 and 11.

Each push-button 9 and 11 is operable to provide a depression stroke and a release stroke, as illustrated. A force applied to push-button 9, for instance, causes it to be depressed inward, compressing the compression coil spring 8. This corresponds to a depression stroke. When push-button 9 is then released, the compression force of spring 8 acts back against push-button 9, causing it to return to its original position, as shown. This corresponds to a release stroke.

Preferably, push-buttons 9 and 11 are retained in place by a tongue-and-groove type arrangement. Tongues 9*a*, for instance, disposed on opposite sides of push-button 9, slide within corresponding grooves formed in the walls of the inner socket portion 1*b*. A recessed area in one of the tongues 9*a* defines a pair of end-of-travel surfaces 9*b*, as shown in dashed lines. These surfaces 9*b* engage a stop 14, as push-button 9 is depressed and released, such that push-button 9 is retained in its socket. This arrangement prevents escape of the push-buttons 9 and 11 and also prevents undesirable rotation within their respective sockets.

The compression springs 8 and 10 are preferably selected such that the push-buttons 9 and 11 have an actuation force of no more than about five pounds, corresponding to the maximum load requirement prescribed by the aforementioned ADA guidelines. The length of the depression stroke "d" may be varied to provide shorter or longer travel, as desired. Push-buttons having a maximum actuation force of about 3.9 pounds and a depression stroke of about 0.13 inches were found to be particularly suitable for use in interior doors of commercial aircraft.

The push-button 11 includes a pawl 35 for engaging the release lever 31 on the release stroke of the push-button 11. This pawl 35 is pivotably mounted about a pivot pin 36 within a cutout portion of the push-button 11, as shown, and is spring-biased toward engagement with the release lever 31 via a torsion spring 37. The pawl 35 includes at least one inclined surface 35*a* and two flat surfaces 35*b* and 35*c*. These surfaces are adapted to engage corresponding inclined and flat surfaces 31*d* and 31*e*, respectively, of the release lever 31.

The preferred angle of inclined surfaces 35*a* and 31*d* is about 45 degrees from the elongated axis of the pawl 35 in order to maximize the transverse reaction force against the pawl 35 when the inclined surfaces 35*a* and 31*d* engage one another. Flat surfaces 35*b*, 35*c* and 31*e* are all preferably perpendicular to the elongated axis of the pawl 35 and parallel to one another, in order to minimize the transverse reaction force against the pawl 35 when these surfaces engage one another.

Operation

Referring to FIGS. 4–7, there are three basic modes of the latch operation that merit particular discussion. These are: (1) releasing the latch from the interior side of a door; (2) releasing the latch from the exterior side of a door; and (3) resetting the latch.

Figure 4A:
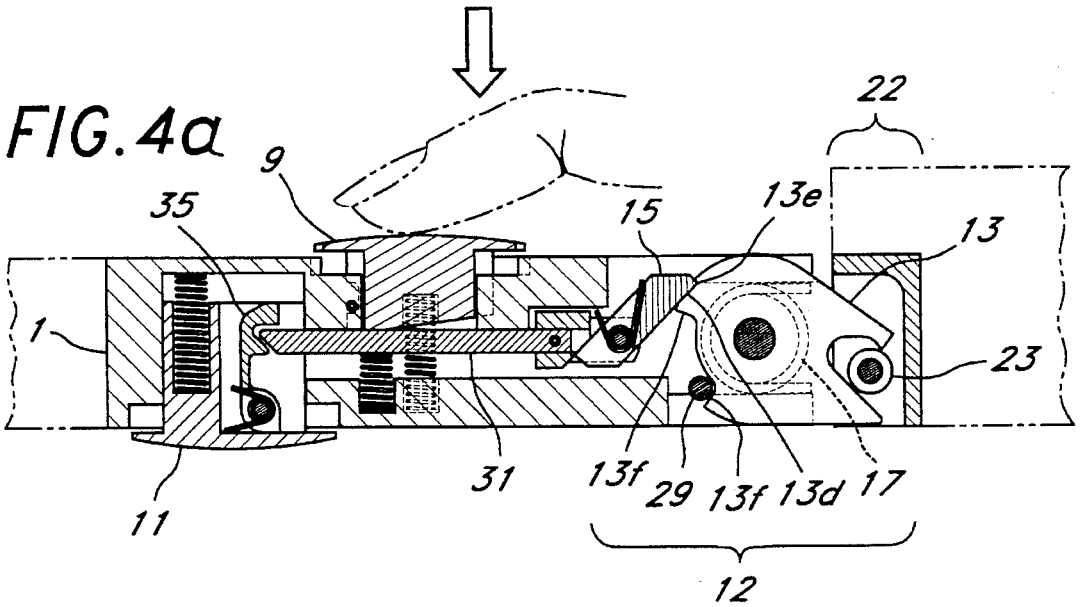
FIGS. 4A–4C present a time-sequenced, sectional top-view of the flush-mounted latch of FIG. 3, illustrating operation of the latch from the interior side of the door.

Having reference to FIG. 4A for interior operation, it may be seen that when the latch assembly 12 is in its locked condition, as shown, the cam 13 straddles the roller-bearing 23 and prevents any relative movement between the latch assembly 12 and the strike assembly 22. The lock bar 15 engages the cam notch surface 13*e* to prevent rotation of the cam 13 in one direction, and the stop 29 engages the cam surface 13*f* to prevent rotation of the cam 13 in the opposite direction. This corresponds to the door being in its closed position.

Figure 4B:
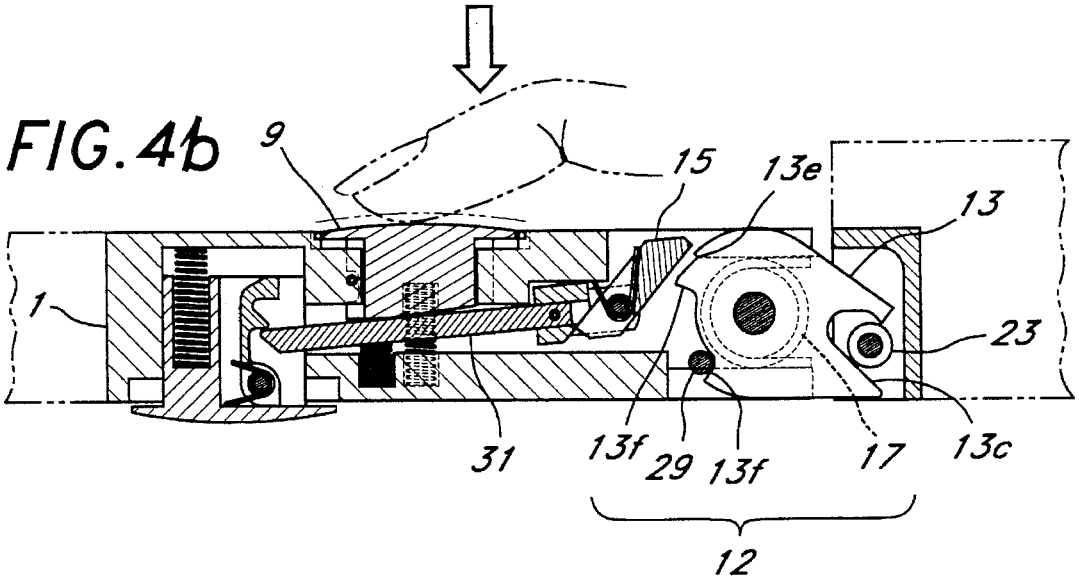
Figure 4C:
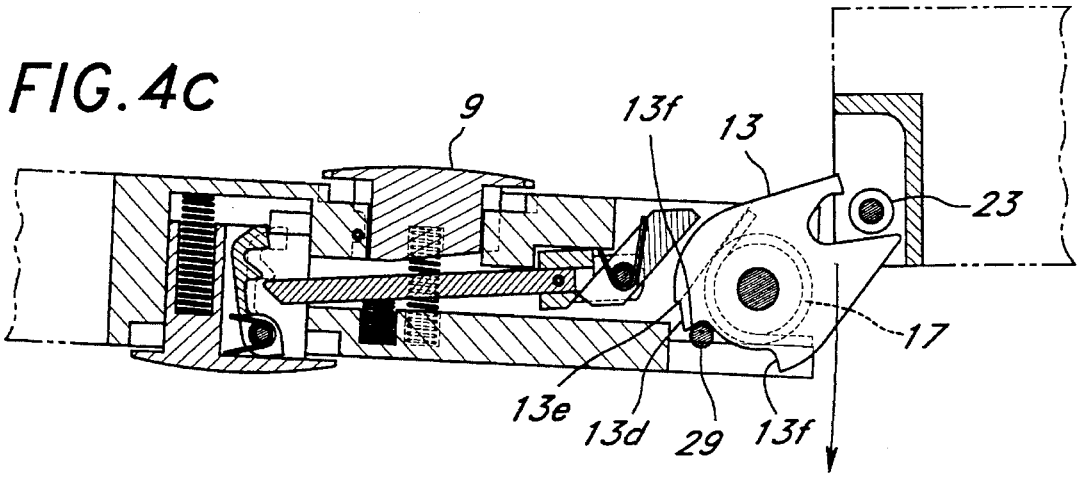

To open the door from the interior side, the push-button 9 is depressed by an operator's finger, as shown in FIG. 4B. This causes the angled lower surface of the push-button 9 to engage the release lever 31, causing it to rotate counter-clockwise. A corresponding rotational movement is produced in the lock bar 15, causing it to disengage from the notch surface 13*e* formed in the peripheral surface of the cam 13. The latch assembly 12 is then released and the cam 13 is allowed to rotate counter-clockwise under the force of the loaded torsion spring 17. This rotation creates a reaction force against the roller-bearing 23 which forces the door to swing out of the door frame, as indicated in FIG. 4C. The efficiency of the cam 13 at converting stored energy in the torsion spring 17 into kinetic energy in the door is increased by the slightly inclined cam surface 13*c*, as shown in FIG. 4B, for engaging the roller-bearing 23.

The outer end-of-travel cam surfaces 13*f* engage the stop 29 to limit the rotation of the cam 13 in the door opening and closing directions, as shown in FIGS. 4*b* and 4*c*. The cam rotation limits are preferably selected to ensure that: (1) upon opening the door, the cam 13 rotates no further than is necessary to completely disengage it from the roller-bearing 23 so that the cam 13 may be restored to its locked condition with the minimal expenditure of energy; and (2) upon closing the door, the cam 13 prevents the door from swinging open in the opposite direction.

Figure 5A:
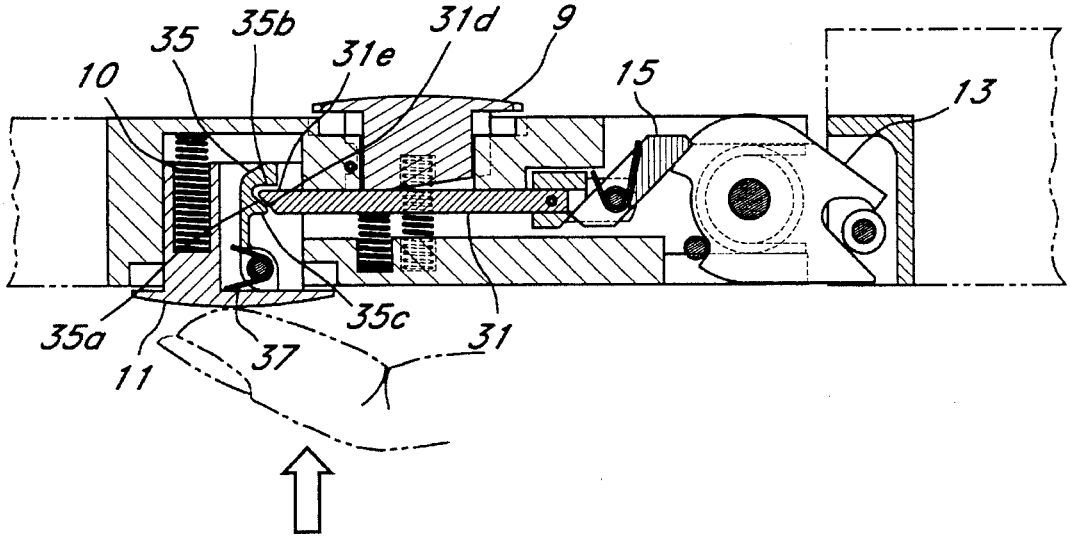
FIGS. 5A–5C present a time-sequenced, sectional top-view of the flush-mounted latch of FIG. 3, illustrating operation of the latch from the exterior side of the door.
Figure 5B:
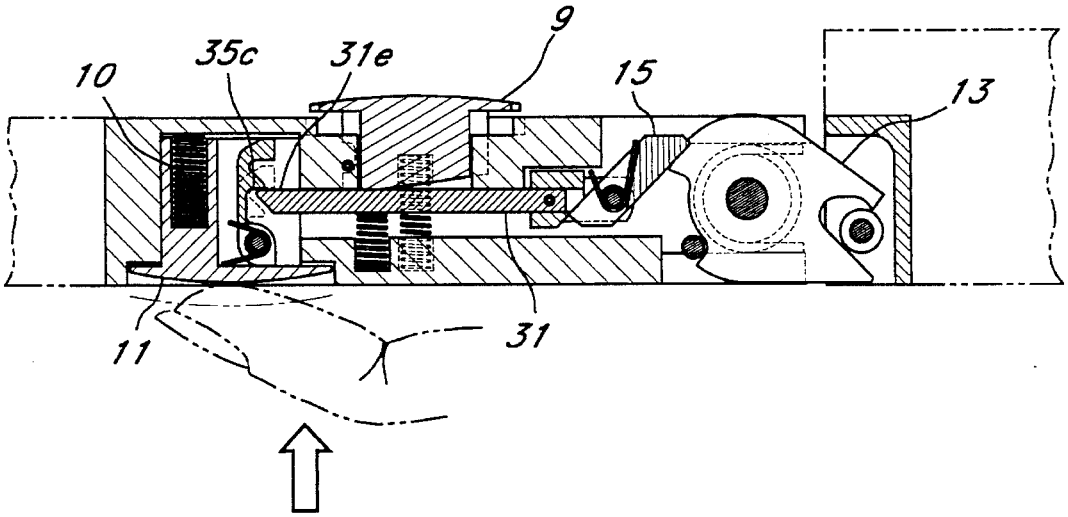
Figure 5C:
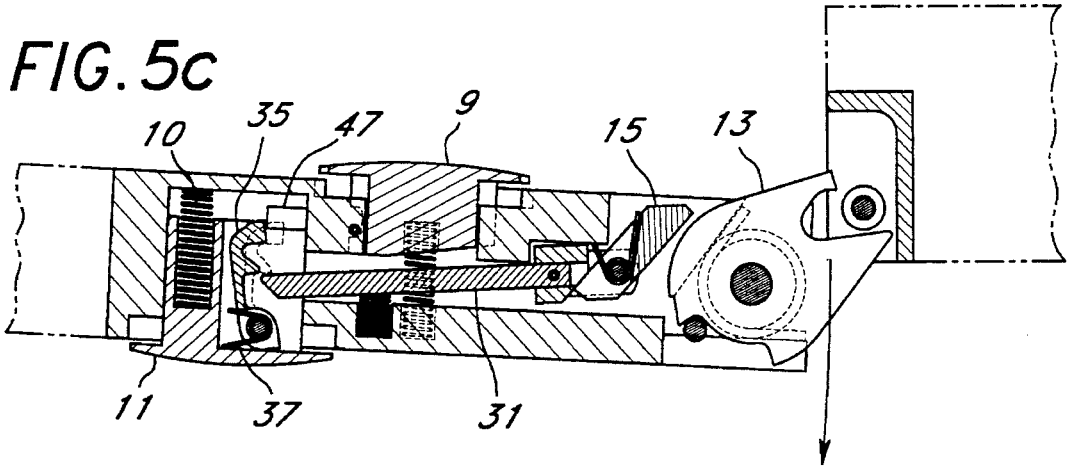

To open the door from the exterior side, the push-button 11 is depressed and then released, as illustrated in FIGS. 5A–5C. This is different from interior operation of the latch, described above, wherein the latch releases immediately upon depressing the push-button 9. This preferred sequence of exterior operation is an important safety feature of the present invention and is designed to prevent injury to an operator's finger.

It will be recalled that for interior operation of the latch, the door swings away from the operator's finger when the push-button 9 is actuated, as was shown in FIGS. 4B and 4C. In contrast, exterior operation requires an operator's finger to be placed in the path of the door as it springs open, as shown in FIGS. 5B and 5C. If the latch were to release immediately upon the depression stroke of the push-button 11, this could jam the operator's finger as it acts against the door. Accordingly, the present invention delays releasing the latch until the push-button 11 begins its release stroke so that the operator's finger may be safely removed before the door springs open.

As understood from FIG. 6A, depressing the push-button 11 causes the inclined surface 35*a* of the pawl 35 to slidingly engage a corresponding inclined surface 31*d* of the release lever 31. This causes a transverse reaction force to act against the pawl 35, deflecting it away from the release lever 31. As push-button 11 reaches the end of its depression stroke, inclined surfaces 35*a* and 31*d* run out of contact area. The torsion spring 37 then causes the pawl 35 to snap back toward the release lever 31, as shown in FIG. 5B.

Releasing the push-button 11 at this point causes the flat surface 35*c* of the pawl 35 to engage the corresponding flat surface 31*e* of the release lever 31. The spring 10 reacts against the push-button 11, causing the pawl 35 to rotate the release lever 31 counter-clockwise. This produces a corresponding rotation in the lock bar 15, as shown in FIG. 5C, disengaging it from the cam 13 and allowing the door to spring open as described above in connection with FIGS. 4A–4C. As the cam 13 reaches its full rotation, the pawl 35 is disengaged from the release lever 31 by a reset pin 47, the operation of which will be described in greater detail below.

Figure 6:
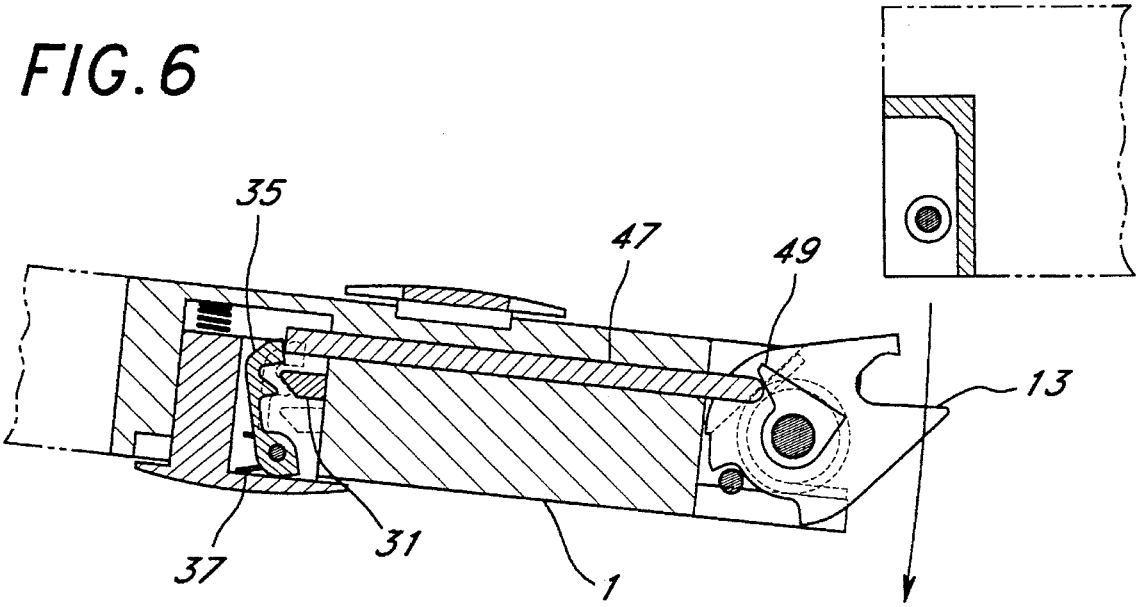
FIG. 6 is a sectional top-view of the flush-mounted latch of FIG. 3 taken from a different elevation, illustrating resetting of the release lever assembly.

FIG. 6 is a sectional top-view of the flush-mounted latch of FIG. 3 taken from a different elevation. It can be seen that the reset pin 47 is slidingly retained within the latch housing 1, extending lengthwise from the pawl 35 to the cam 13. An actuator arm 49 is connected to and rotates with the cam 13. As the cam 13 rotates to its open position, as shown, this actuator arm 49 engages the reset pin 47, forcing it against the pawl 35. This disengages the pawl 35 from the release lever 31, allowing the release lever 31 to spring back to its original position, as shown. When the door is again closed, the reactive force exerted on the reset pin 47 by the pawl 35 and its corresponding torsion spring 37 forces the reset pin 47 back to its initial position.

Figure 7A:
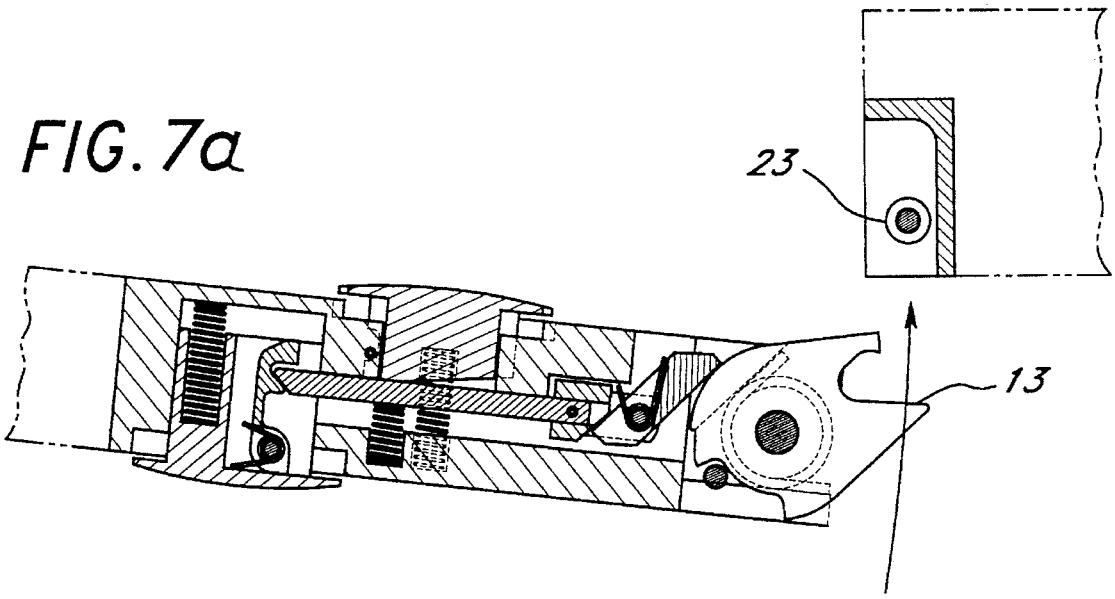
FIGS. 7A–7C present a time-sequenced, sectional top-view of the flush-mounted latch of FIG. 3, illustrating resetting of the latch.
Figure 7B:
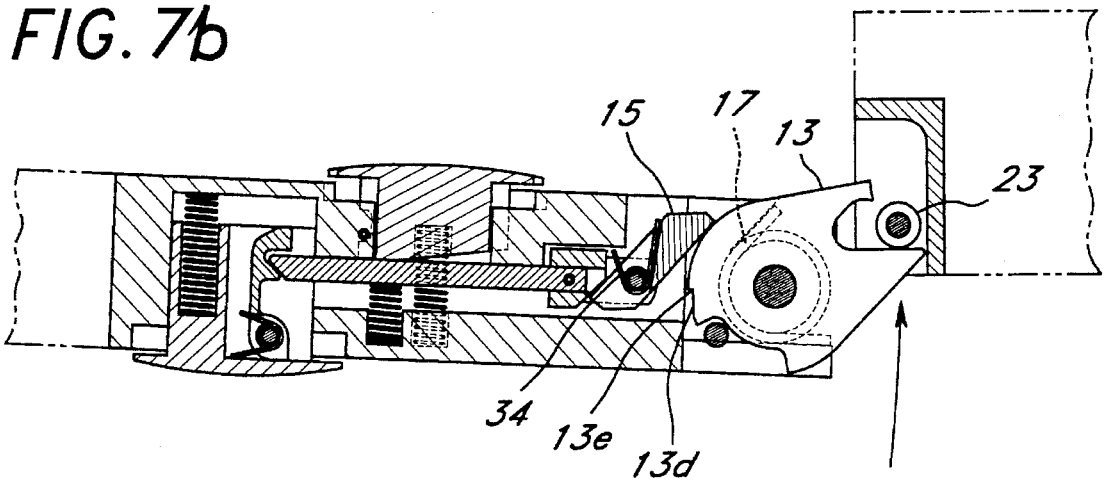
Figure 7C:
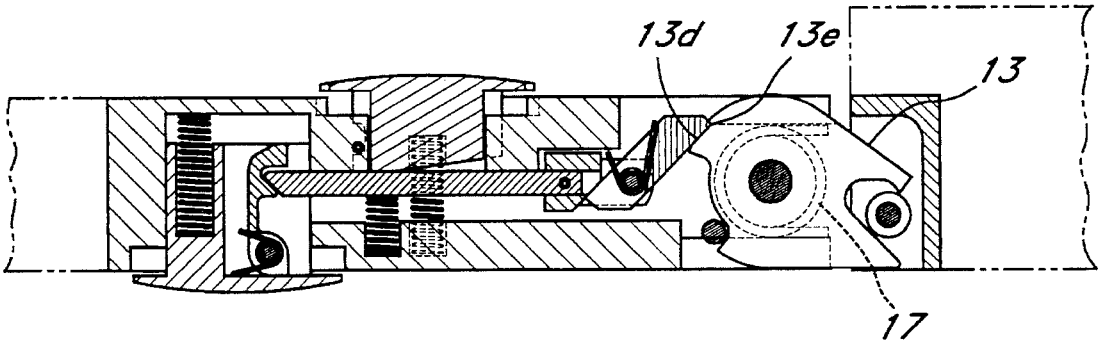

The final mode of operation, resetting of the latch, is accomplished by simply moving the door toward its closed position, as shown in FIGS. 7A–7C. As the cam 13 comes back into engagement with the roller-bearing 23, as shown in FIG. 7B, the cam 13 rotates clockwise, reloading the torsion spring 17. The lock bar 15 is riding the contoured surface of the cam 13 at this point, being urged against it by the torsion spring 34. As the cam 13 continues to rotate clockwise, the lock bar 15 eventually snaps into the notch defined by surfaces 13*d* and 13*e* formed in the peripheral surface of the cam 13, as shown in FIG. 7C. This locks the cam 13 into its spring-loaded captive position and the latch is set and ready to be reactivated. This sequence of operation repeats itself every time the door is opened and closed.

With this invention thus explained, it will become readily apparent to those skilled in the art that numerous modifications and variations can be made without departing from the scope and spirit of this invention. It is therefore intended that this invention be limited only as indicated in the appended claims.

What is claimed is:

1. A touch-operated latch for mounting within a door, said latch comprising, in combination:

(a) a latch housing;

(b) a spring-loaded cam pivotably mounted within said latch housing and adapted to engage a corresponding strike assembly mounted adjacent to said latch, said spring-loaded cam being adapted to store energy when said door is in its closed position and to release said stored energy as kinetic energy to open said door;

(c) a lock bar engaging said spring-loaded cam operable to prevent said spring-loaded cam from rotating while said door is in its closed position;

(d) a release lever assembly operable to release said lock bar to allow said spring-loaded cam to rotate and disengage said strike assembly releasing said stored energy; and (e) a touch-operated actuation device for activating said release lever assembly to allow said door to move to its open position said touch-operated actuation device having an actuation force of no more than about five pounds.

2. The touch-operated latch of claim 1, wherein said spring-loaded cam includes a pair of spaced fingers forming an opening at one end, adapted to accommodate a roller-bearing mounted within said corresponding strike assembly.

3. The touch-operated latch of claim 2, wherein said lock bar comprises a rotatable lock member having a first contact surface disposed on one end thereof and wherein said spring-loaded cam further includes a notch formed in its peripheral surface for engagement with said lock bar, said notch having a second contact surface formed substantially parallel to said first contact surface and substantially perpendicular to an imaginary radial line passing through the axis of rotation of said rotatable lock member and said first and second contact surfaces.

4. The touch-operated latch of claim 1, wherein said release lever assembly comprises a release lever pivotably mounted with respect to said latch housing and in engagement with said lock bar.

5. The touch-operated latch of claim 4, wherein said release lever and said lock bar are pivotably mounted for rotation about the same axis and are hinged together at their pivot points.

6. The touch-operated latch of claim 1, wherein said touch-operated actuation device comprises a push-button mounted substantially flush with the surface of said door such that said push-button protrudes no farther than about 0.14 inches from the outer surface of said latch housing.

7. The touch-operated latch of claim 6, wherein said push-button has an actuation force of about 3.9 pounds.

8. The touch-operated latch of claim 1, wherein said touch-operated actuation device comprises first and second push-buttons mounted on opposite sides of said door, each of said first and second push-buttons having a depression stroke and a release stroke and wherein said release lever assembly comprises a release lever pivotably mounted with respect to said latch housing, responsive to the depression stroke of said first push-button and the release stroke of said second push-button.

9. A flush-mounted latch for interior and exterior operation of a door, said latch comprising, in combination:

(a) a spring-loaded latch assembly adapted to retain said door in its closed position when said latch assembly is locked, and further adapted to urge said door to its open position when said latch assembly is released;

(b) first and second push-buttons mounted substantially flush with the interior and exterior surfaces of said door, respectively, each of said first and second push-buttons having a depression stroke and a release stroke; and (c) a release mechanism responsive to the depression stroke of said first push-button and the release stroke of said second push-button for releasing said latch assembly.

10. The flush-mounted latch of claim 9, wherein said latch assembly comprises, in combination:

(a) a latch housing;

(b) a spring-loaded cam pivotably mounted within said latch housing and adapted to engage a corresponding strike assembly mounted adjacent to said latch said spring-loaded cam including an opening formed at one end adapted to accommodate a roller-bearing mounted within said corresponding strike assembly; and (c) a lock bar engaging said spring-loaded cam operable to prevent said spring-loaded cam from rotating while said door is in its closed position.

11. The flush-mounted latch of claim 9, wherein said first and second push-buttons have an actuation force of no more than about five pounds.

12. The flush-mounted latch of claim 11, wherein said first and second push-buttons protrude no further than about 0.14 inches from said door and have a depression stroke of no more than about 0.13 inches.

13. The flush-mounted latch of claim 9, wherein said release mechanism comprises a release lever pivotably mounted with respect to said latch assembly.

14. The flush-mounted latch of claim 13, wherein said first push-button includes a contact surface adapted to actuate said release lever upon the depression stroke of said first push-button, and said second push-button carries a pawl adapted to actuate said release lever upon the release stroke of said second push-button.

15. The flush-mounted latch of claim 14 further comprising a reset pin to disengage said pawl from said release lever after said latch assembly has been released.

16. A touch-operated latch for accommodating two-sided operation of a door, said latch comprising, in combination:

(a) a spring-loaded latch assembly adapted to retain said door in its closed position when said latch assembly is locked, and to urge said door to its open position when said latch assembly is released;

(b) a release lever assembly comprising a release lever pivotably mounted with respect to said latch assembly operable to release said latch assembly;

(c) a first touch-operated actuation device mounted on one side of said door, said first touch-operated actuation device having a depression stroke and a release stroke and including a contact surface adapted to actuate said release lever upon the depression stroke of said first touch-operated actuation device; and (d) a second touch-operated actuation device mounted on another side of said door, said second touch operated actuation device having a depression stroke and a release stroke and including a pawl adapted to engage said release lever upon the release stroke of said second touch-operated actuation device.

17. The touch-operated latch of claim 16, wherein said latch assembly comprises, in combination:

(a) a latch housing;

(b) a spring-loaded cam pivotably mounted within said latch housing and adapted to engage a corresponding strike assembly mounted adjacent to said latch; and (c) a lock bar engaging said spring-loaded cam operable to prevent said spring-loaded cam from rotating while said door is in its closed position.

18. The touch-operated latch of claim 16, wherein said first touch-operated actuation device and said second touch-operated actuation device comprise first and second push-buttons mounted substantially flush with the surface of said door.

19. The touch-operated latch of claim 18, wherein said first and second push-buttons have an actuation force of no more than about five pounds.

20. The touch-operated latch of claim 16, wherein said pawl is pivotably mounted with respect to said second touch-operated actuation device and is spring-loaded toward engagement with said release lever.

21. The touch-operated latch of claim 20, wherein said pawl includes an inclined surface adapted to slide along a corresponding inclined surface of said release lever during the depression stroke of said second touch-operated actuation devise, and a flat surface adapted to engage a corresponding flat surface of said release lever during the release stroke of said second touch-operated actuation device.

22. The touch-operated latch of claim 16 further comprising a reset pin adapted to disengage said pawl from said release lever once said latch assembly has been released.

23. A flush-mounted latch for interior and exterior operation of a door, said latch comprising, in combination:

(a) a latch housing;

(b) a spring-loaded cam pivotably mounted within said latch housing and adapted to engage a corresponding strike assembly mounted adjacent to said latch;

(c) a lock bar engaging said spring-loaded cam operable to prevent said spring-loaded cam from rotating while said door is in its closed position;

(d) a release lever assembly comprising a release lever pivotably mounted with respect to said latch housing operable to release said lock bar to allow said spring-loaded cam to rotate and disengage said strike assembly;

(e) a first push-button, having a depression stroke and a release stroke, mounted substantially flush with the interior surface of said door, including a contact surface adapted to engage said release lever upon the depression stroke of said first push-button;

(f) a second push-button, having a depression stroke and a release stroke, mounted substantially flush with the exterior surface of said door, including a pawl adapted to engage said release lever upon the release stroke of said second push-button; and (g) a reset pin extending between and engaging said spring-loaded cam and said pawl, for disengaging said pawl from said release lever when said spring-loaded cam is released.

24. The flush-mounted latch of claim 23, wherein said spring-loaded cam includes an opening formed at one end adapted to accommodate a roller-bearing mounted within said corresponding strike assembly.

25. The flush-mounted latch of claim 24, wherein said first and second push-buttons have an actuation force of no more than about five pounds.

26. A cam for use in a touch-operated spring-loaded door latching device, said cam comprising, in combination:

(a) an oblong shaped disk, having a larger end and a narrower end, adapted for spring loaded mounting about a centrally located pivot axis;

(b) an opening formed in the narrower end of said oblong shaped disk defining first and second cam fingers for engaging and retaining a corresponding strike assembly mounted adjacent to said cam;

(c) a notch formed in the peripheral surface of the larger end of said oblong shaped disk defining therein a contact surface adapted for locked engagement with a lock bar, said contact surface lying in an imaginary radial plane containing said pivot axis of said oblong shaped disk; and (d) a circumferentially extending recessed area formed in the peripheral surface of the larger end of said oblong shaped disk defining end-of-travel surfaces adapted to engage a stop for limiting the angular rotation of said cam between predetermined limits.

27. The cam of claim 26 wherein said first cam finger is formed such that it is adapted to engage a roller-bearing disposed within said corresponding strike assembly when said cam is at one end of its allowed angular rotation and disengage said roller bearing when said cam is at the other end of its allowed angular rotation.

28. The cam of claim 27 wherein said second cam finger is wedge shaped and has an inclined surface adapted for maintaining rolling contact with said roller-bearing disposed within said corresponding strike assembly.

29. A method for two-sided touch operation of a door latch installed within a door, said method comprising the following steps:

(a) actuating the latch by either depressing a first push-button disposed on the interior side of said door, or depressing and then releasing a second push-button disposed on the exterior side of said door;

(b) rotating a release lever in response to said actuation;

(c) disengaging a lock bar from locked engagement with a spring-loaded cam; and (d) allowing said spring-loaded cam to rotate and release sufficient kinetic energy to disengage said door latch from a corresponding strike assembly mounted adjacent to said door.

30. A method for touch operation of a door latch, said method comprising the following steps:

(a) storing energy in said door latch by rotating a spring-loaded cam against a strike assembly until said spring-loaded cam is in locked engagement with said strike assembly;

(b) depressing a push-button disposed on said door latch causing a pawl to slidingly engage a release lever in a first direction;

(c) releasing said push-button causing said pawl to lockingly engage said release lever in a second direction substantially opposite said first direction, thereby releasing said spring-loaded cam; and (d) allowing said spring-loaded cam to rotate against said strike assembly releasing said stored energy as kinetic energy and disengaging said door latch from said strike assembly.

31. A touch-operated latch for mounting within a door, said latch comprising, in combination:

(a) a latch housing;

(b) a spring-loaded cam pivotably mounted within said latch housing and adapted to engage a corresponding strike assembly mounted adjacent to said latch, said spring-loaded cam being adapted to store energy when said door is in its closed position;

(c) a lock bar engaging said spring-loaded cam operable to prevent said spring-loaded cam from rotating while said door is in its closed position;

(d) a release lever assembly operable to release said lock bar to allow said spring-loaded cam to rotate against said strike assembly releasing said stored energy as kinetic energy to open said door; and (e) a touch-operated actuation device having a depression stroke and a release stroke, said touch-operated actuation device being adapted to activate said release lever assembly only upon said release stroke.

32. The touch-operated latch of claim 31 wherein said touch-operated actuation device has an actuation force of no more than about five pounds.

33. A latch for mounting within a door comprising, in combination:

(a) an engagement member for positively engaging a corresponding strike member mounted adjacent to said latch;

(b) means for storing energy in said latch when said door is in its closed position;

(c) an actuator accessible from at least one side of said door, said actuator having a depression stroke and a release stroke; and (d) a release mechanism responsive to the release stroke only of said actuator for releasing said energy stored in said latch as kinetic energy to open said door.

34. The latch of claim 33, wherein said actuator is a push button having an actuation force of no more than about five pounds.

35. The latch of claim 34, wherein said push button has an actuation force of about 3.9 pounds.

36. The latch of claim 33, wherein said actuator is mounted substantially flush with the outer surface of said door such that said actuator protrudes no farther than about 0.14 inches from said door.

37. The latch of claim 33, wherein said actuator is mounted on the side of said door toward which said door opens when said latch is released.

38. The latch of claim 33, wherein said means for storing energy comprises a spring loaded cam adapted to rotate against said strike member said spring loaded cam having an opening at one end adapted to accommodate a roller bearing mounted in said strike member.

39. The latch of claim 33, further comprising a second actuator accessible from another side of said door for facilitating operation of said door from both sides, said second actuator having a depression stroke and release stroke and wherein said release mechanism is responsive to the depression stroke of said second actuator for releasing said energy stored in said latch as kinetic energy to open said door.

40. A touch-operated latch for mounting within a door, said latch comprising, in combination:

(a) a latch housing;

(b) a spring-loaded cam pivotably mounted within said latch housing and having a pair of spaced fingers forming an opening at one end adapted to accommodate a roller-bearing mounted within said corresponding strike assembly, said spring-loaded cam being adapted to store energy when said door is in its closed position and to release said stored energy as kinetic energy to open said door;

(c) a lock bar engaging said spring-loaded cam operable to prevent said spring-loaded cam from rotating while said door is in its closed position;

(d) a release lever assembly operable to release said lock bar to allow said spring-loaded cam to rotate and disengage said strike assembly releasing said stored energy; and (e) a touch-operated actuation device for activating said release lever assembly to allow said door to move to its open position.

41. The touch-operated latch of claim 40, wherein said lock bar comprises a rotatable lock member having a first contact surface disposed on one end thereof and wherein said spring-loaded cam further includes a notch formed in its peripheral surface for engagement with said lock bar, said notch having a second contact surface formed substantially parallel to said first contact surface and substantially perpendicular to an imaginary radial line passing through the axis of rotation of said rotatable lock member and said first and second contact surfaces.

42. A touch-operated latch for mounting within a door, said latch comprising, in combination:

(a) a latch housing;

(b) a spring-loaded cam pivotably mounted within said latch housing and adapted to engage a corresponding strike assembly mounted adjacent to said latch, said spring-loaded cam being adapted to store energy when said door is in its closed position and to release said stored energy as kinetic energy to open said door;

(c) a lock bar engaging said spring-loaded cam operable to prevent said spring-loaded cam from rotating while said door is in its closed position;

(d) a release lever assembly comprising a release lever pivotably mounted with respect to said latch housing and in engagement with said lock bar operable to release said lock bar to allow said spring-loaded cam to rotate and disengage said strike assembly releasing said stored energy; and (e) a touch-operated actuation device for activating said release lever assembly to allow said door to move to its open position.

43. The touch-operated latch of claim 42, wherein said release lever and said lock bar are pivotably mounted for rotation about the same axis and are hinged together at their pivot points.

* * * * *